United States Patent [19]

Bratt

[11] Patent Number: 4,665,700

[45] Date of Patent: May 19, 1987

[54] HOT GAS ENGINE HEATER HEAD

[75] Inventor: Jan C. Bratt, Malmö , Sweden

[73] Assignee: United Stirling AB, Malmö , Sweden

[21] Appl. No.: 852,071

[22] Filed: Jul. 1, 1985

Related U.S. Application Data

[63] Continuation of Ser. No. 571,709, Jan. 18, 1984, abandoned.

[51] Int. Cl.[4] ..... F02G 1/04

[52] U.S. Cl. ..... 60/517; 60/524; 60/525; 126/442

[58] Field of Search ..... 60/517, 524, 525; 126/442

[56] References Cited

U.S. PATENT DOCUMENTS

| | | | |
|---|---|---|---|
| 2,828,601 | 4/1953 | Meyer | 60/525 |
| 3,822,552 | 7/1974 | Palmgren | 60/517 |
| 3,991,457 | 11/1976 | Barton | 60/517 |
| 4,069,670 | 1/1978 | Bratt et al. | 60/517 |
| 4,117,679 | 10/1978 | Grahn | 60/525 |
| 4,345,645 | 8/1982 | Bratt | 60/517 |
| 4,395,879 | 8/1983 | Berntell . | |
| 4,422,291 | 12/1983 | Berntell | 60/517 |

OTHER PUBLICATIONS

United Stirling 1980 Final Report "Design Study of a Kinematic Stirling Engine for Dispersed Solar Electric Power Systems", DOE/NASA/0056-79/2, NASA CR-159588, Mar. 1981, pp. Cover and 7-9, 55-65.

*Primary Examiner*—Carroll B. Dority, Jr.
*Assistant Examiner*—H. A. Odar
*Attorney, Agent, or Firm*—Finnegan, Henderson, Farabow, Garrett & Dunner

[57] ABSTRACT

A heater head for a multi-cylinder double-acting hot gas engine of the type having an annular regenerator surrounding each cylinder is provided with tubes connecting each cylinder with its surrounding regenerator. All tubes have three tube parts of identical shape. A first tube part is of involute shape and a second and a third tube part are of different involute shape. Half of all tubes have their first tube part connected to the cylinders, while the other half of the tubes have their first tube part connected to the regenerator.

7 Claims, 3 Drawing Figures

HOT GAS ENGINE HEATER HEAD

This application continuation of application Ser. No. 571,709, filed Jan. 18, 1984, now abandoned.

BACKGROUND OF THE INVENTION

1. Field of the Invention

This invention relates to a heater head for a multi-cylinder double-acting hot gas engine of the kind adapted to absorb concentrated solar radiation and comprising a plurality of tubes having first tube parts following involute curves on an imaginary conical surface and second and third tube parts following other involute curves on the same conical surface radially outside said first parts.

2. Description of the Prior Art.

The U.S. Pat. No. 4,345,645 shows a heater head of the type referred to above and adapted to connect a number of cylinders with the double number of separate regenerator housings.

This known design is adapted for tube connections between regenerators and cylinders being almost 90 degrees angularly displaced.

However, it is desirable to be able to use tubes following two involute curves also in heater heads of the type having regenerators coaxially surrounding the cylinders.

SUMMARY OF THE INVENTION

The object of the present invention is to provide a heater head of the type referred to above in which the regenerators to be connected to the cylinders by the tubes may surround said cylinders.

According to the present invention this is obtained thereby that 50% of the tubes have their first tube part connected to a regenerator housing and their third tube part connected to a cylinder surrounded by said regenerator housing, while the remaining tubes have their first tube part connected to a cylinder and their third tube part connected to a regenerator housing surrounding said cylinder.

The invention will be described in more detail reference being made to the accompanying drawings.

DETAILED DESCRIPTION OF THE DRAWINGS

Figure 1:
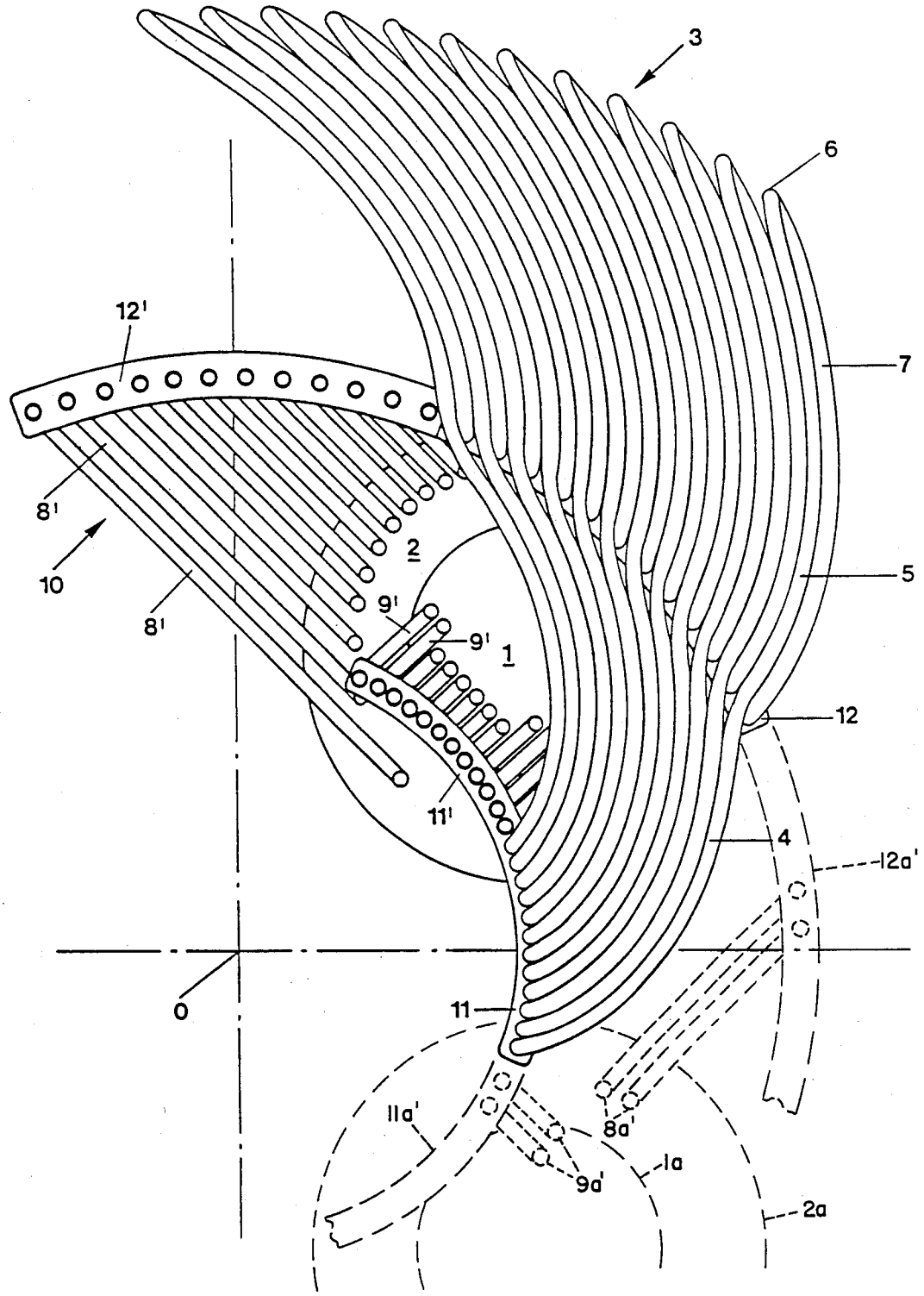
FIG. 1 is a plan view showing—parts of a quadrant of a heater head according to the invention.

Referring first to FIG. 1 the reference numeral 1 designates one cylinder of a four cylinder hot gas engine. Said cylinder 1 is surrounded by a regenerator housing 2 and the quadrant of the heater head shown should comprise a number of tubes connecting the interior of the cylinder 1 with the interior of the regenerator housing 2. The remaining three quadrants are equally shaped. Portions of adjacent cylinder 1*a*, regenerator housing 2*a*, and the heater head components connected thereto are shown by dashed lines. The center of the heater head is designated by O.

FIG. 1 shows twelve tubes indicated by the common reference 3 connected at their lower ends—as viewed in FIG. 1—to the regenerator housing 2 and with their upper ends to the cylinder 1.

Figure 2:
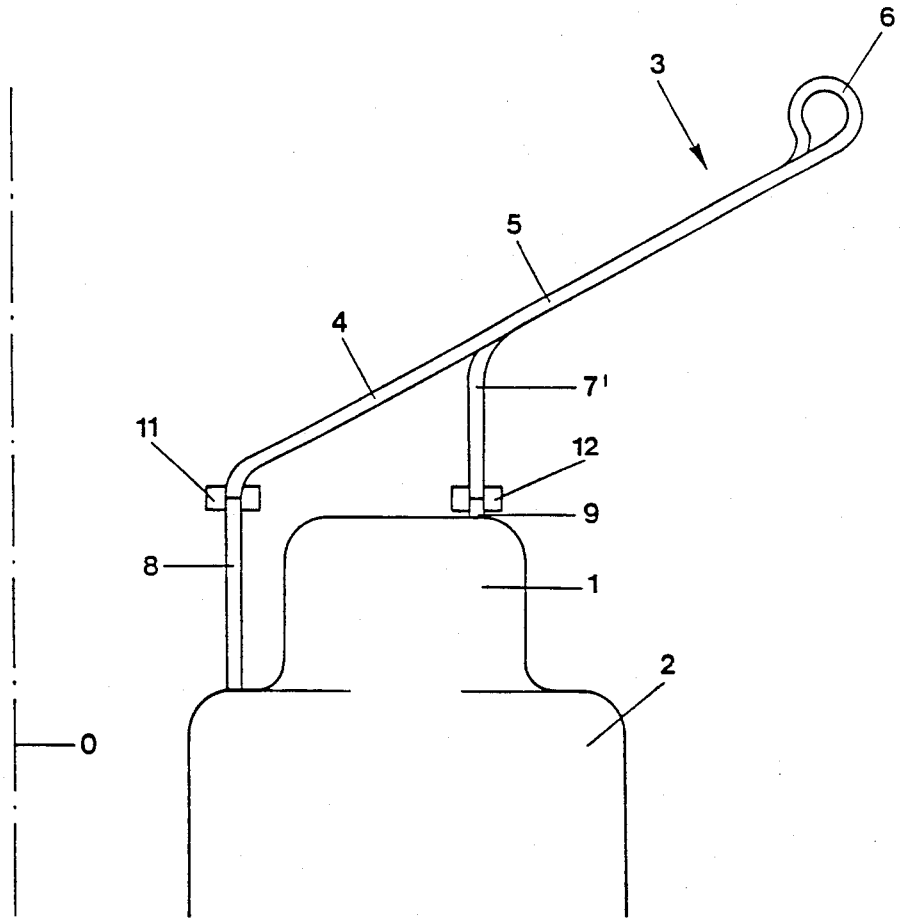
FIG. 2 shows a vertical section through the quadrant of FIG. 1.

One of said tubes 3 is shown in FIG. 2. Each tube 3 has a first part 4 following an involute curve on an imaginary conical surface. Said first part 4 is extended radially outwardly by a second part 5 following another involute curve on the same conical surface. The second part 5 terminates into a 180 degrees sharp bend 6 and continues as an inwardly directed third part 7 parallel to the second part 5. Said third part 7 terminates into a vertically downwardly directed part 7'.

Whereas all tubes 3 have indentical parts 4, 5, 6, 7 and 7' connections 8 to the regenerator housing 2 and connections 9 to the cylinder 1 are of individual shape and length so as to obtain an almost even distribution of the tube connections 8, 9 to the cylinder 1 and the regenerator housing 2. FIG. 1 does not show the said connections.

The quadrant of FIG. 1 also comprises twelve tubes 10 of basically the same type as the tubes 3. However, in FIG. 1 the parts 4–7' have been omitted whereas connections 8', 9' have been shown.

Figure 3:
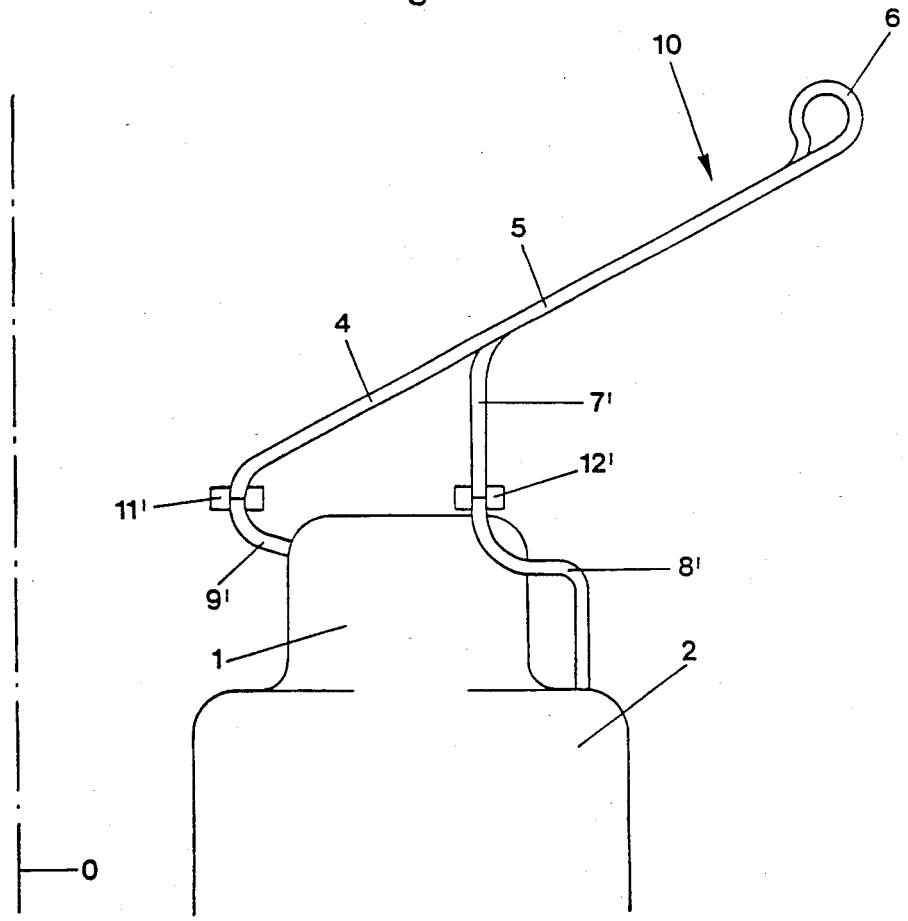
FIG. 3 shows another vertical section through the quadrant of FIG. 1.

FIG. 3 shows one of the tubes 10 having connections 8' to the regenerator housing 2 at the right in FIG. 3 and connections 9' to the cylinder 1 at the left in FIG. 3.

The tube parts 4–7' of the tubes 10 are of the same shape as the corresponding parts of the tubes 3.

The tube connections 8 and the involute parts 4 of the tubes 3 are brazed together—an arcuately shaped spacer 11 being used for assisting the brazing operation.

Corresponding spacers 11', 12 and 12' are used for assisting the brazing of the connections 9' to the parts 4, the connections 9 to the parts 7' and the connections 8' to the parts 7'.

It will be understood that the spacers 11 and 11' as well as the spacers 12 and 12' form quadrants of full circles.

As mentioned above the involute parts of the tubes 10 have been omitted in FIG. 1. This Figure, however, shows the connections 8' and 9' (nearly all of them), whereas the connections 8 and 9 belonging to the tubes 3 have been omitted from FIG. 1. FIG. 1 also shows (with dashed lines) connections 8*a'* and 9*a'* and spacers 11*a'* and 12*a'*, which are connected to cylinder 1*a* and regenerator housing 2'a positioned in the quandrant adjacent cylinder 1 and regenerator housing 2.

Again the connections 8' and 9' are of individual shape and length in order to obtain almost equally spaced connections to the cylinder 1 and the regenerator housing 2.

I claim:

1. A heater head for a multi-cylinder double-acting hot gas engine powered by solar radiation and having each cylinder coaxially surrounded by a regenerator, comprising:

a plurality of heater tubes for conducting gas flow between each of said cylinders and the regenerator surrounding said cylinder, each of said heater tubes including serially connected first, second, and third tube parts, said first part following a first involute curve on an imaginary conical surface, said second part following a second involute curve on said imaginary conical surface radially outside said first part, and said third part following a third involute curve on said imaginary conical surface radially outside said first part; and means for separately connecting each of said heater tubes between an individual cylinder and the regenerator surrounding said individual cylinder, one half of said heater tubes connecting each of said cylinders to its surrounding regenerator having their first parts connected to said cylinder and their third parts connected to said regenerator, and the other half of said heater tubes connecting each of said cylinders to its surrounding regenerator having their first parts connected to said regenerator and their third parts connected to said cylinder, the direction of gas flow in said one half of said heater tubes being opposite the direction of gas flow in said other half of said heater tubes.

2. The heater head according to claim 1, wherein all of said tubes of the heater head have first, second, and third tube parts of identical shape.

3. The heater head of claim 1, wherein each of said heater tubes further includes a 180° tube part connecting said second and third tube parts.

4. The heater head of claim 1, wherein said means for separately connecting each of said heater tubes between an individual cylinder and the regenerator surrounding said individual cylinder further includes first cylinder connection tubes, first regenerator connection tubes, second cylinder connection tubes, and second regenerator connection tubes, each tube of said one half of said heater tubes having its first tube part separately connected to its respective cylinder by an individual first cylinder connection tube and its third tube part separately connected to its respective regenerator by an individual first regenerator connection tube, and each tube of said other half of said heater tubes having its third tube part separately connected to its respective cylinder by an individual second cylinder connection tube and its first tube part separately connected to its respective regenerator by an individual second regenerator connection tube.

5. The heater head of claim 4, further comprising first and second spacers for maintaining even spacing between adjacent heater pipes.

6. The heater head of claim 5, wherein said first spacer supports said first regenerator connection tube and said second cylinder connection tube, and said second spacer supports said first cylinder connection tube and said second regenerator connection tube.

7. The heater head of claim 6, wherein said first and second spacers are circular in shape and concentric with said imaginary conical surface.

* * * * *